US010281107B1

(12) United States Patent
Lacroix

(10) Patent No.: US 10,281,107 B1
(45) Date of Patent: May 7, 2019

(54) CAP ASSEMBLY AND VENT BODY FOR A LIGHT HOUSING ON A VEHICLE

(71) Applicant: GM GLOBAL TECHNOLOGY OPERATIONS LLC, Detroit, MI (US)

(72) Inventor: Joachim Lacroix, Flonheim (DE)

(73) Assignee: GM GLOBAL TECHNOLOGY OPERATIONS LLC, Detroit, MI (US)

( * ) Notice: Subject to any disclaimer, the term of this patent is extended or adjusted under 35 U.S.C. 154(b) by 0 days.

(21) Appl. No.: 16/018,464

(22) Filed: Jun. 26, 2018

(51) Int. Cl.
*F21S 45/33* (2018.01)

(52) U.S. Cl.
CPC ..... *F21S 45/33* (2018.01)

(58) Field of Classification Search
CPC ..... F21S 45/33; F21S 45/20; F21S 45/10
See application file for complete search history.

(56) References Cited

U.S. PATENT DOCUMENTS

| | | | | |
|---|---|---|---|---|
| 8,414,672 | B2 * | 4/2013 | Furuyama | B01D 46/2414 55/385.4 |
| 8,814,993 | B2 * | 8/2014 | Yano | F21S 45/30 96/4 |
| 2003/0216119 | A1 * | 11/2003 | Mashiko | F21V 31/03 454/275 |
| 2009/0109618 | A1 * | 4/2009 | Yano | F21V 31/03 361/694 |
| 2011/0016836 | A1 * | 1/2011 | Yano | B60R 16/0239 55/491 |
| 2012/0044711 | A1 * | 2/2012 | Konishi | F21S 41/147 362/487 |
| 2013/0025457 | A1 * | 1/2013 | Furuuchi | F21V 31/03 96/4 |
| 2015/0062940 | A1 * | 3/2015 | Scagliarini | F21V 31/03 362/487 |
| 2015/0313034 | A1 * | 10/2015 | Yano | H05K 5/0213 428/68 |

FOREIGN PATENT DOCUMENTS

| | | | | |
|---|---|---|---|---|
| CN | 101975386 | B * | 4/2012 | |
| DE | 19502343 | A1 * | 8/1995 | H02B 1/56 |
| DE | 19505207 | C2 | 8/1995 | |
| DE | 10055152 | A1 * | 5/2002 | F21S 45/33 |
| DE | 102008064344 | A1 * | 7/2010 | F21S 45/43 |
| EP | 0571272 | A1 * | 11/1993 | F21S 45/33 |
| JP | 06187807 | A * | 7/1994 | F21S 45/33 |
| KR | 101278207 | B1 * | 7/2013 | |

* cited by examiner

*Primary Examiner* — Donald L Raleigh
(74) *Attorney, Agent, or Firm* — Lorenz & Kopf, LLP

(57) ABSTRACT

A vent cap has a cap wall extending an inner surface of a cap base. First and second sealing lips extend starting from the cap base. Each sealing lip has at least one cutaway such that two adjacent cutaways are offset with respect to each other. A vent body has a plate with an opening formed therethrough. Inner and outer guide walls extend vent body plate and at least partially encircle the ventilation opening. The cap base lies flush against an outer wall of the vent body such that the first and second sealing lips lie flush against the outer wall of the vent body to form a flow path with a first labyrinthine course in a radial direction and a second labyrinthine course in a vertical direction between the vent body plate and the base body.

16 Claims, 6 Drawing Sheets

CAP ASSEMBLY AND VENT BODY FOR A LIGHT HOUSING ON A VEHICLE

TECHNICAL FIELD

The present disclosure pertains to a cap configured to fit over a ventilation opening of a light housing for a vehicle, as well as an assembly including a cap and a light housing.

BACKGROUND

Motor vehicles are equipped with a plurality of light housings, on the front of the vehicle (headlights or lamp) and the rear of the vehicle (taillights), for example. In order to prevent condensation from forming inside such a light housing, it is common practice to furnish the housings with ventilation openings, which enable an exchange of air between the interior of the housing and the outside atmosphere.

Such arrangements constantly encounter the problem according to which the exchange of air in turn makes it possible for moisture-laden air and dirt particles to get into the interior of the light housing. To address this problem, DE 195 05 207 C2 suggests a ventilation device for a housing with a ventilation opening in which the flow path is directed by guide walls in a labyrinth-like arrangement, so that any condensation which is likely to form occurs in this labyrinth, and is kept away from the interior of the housing.

However, it has been found in practice that particularly under conditions of air with a high moisture content or heavy contaminant load some condensation and/or dirt may still be deposited in the interior of light housings. Accordingly, there is a need in the art to provide solutions are more effective for minimizing or eliminating penetration of the interior of a light housing by dirt particles and/or condensing moisture.

SUMMARY

In accordance with the present disclosure, a cap is provided for placing over a vent body of a motor vehicle light housing. The cap has a flat cap base body with an outer surface and an inner surface opposite the outer surface. A cap wall is arranged on the inner surface and extends substantially vertically starting therefrom. At least one first sealing lip and one second sealing lip radiate from the outer surface of the cap wall parallel to the cap base body and at various distances from the cap base body as sealing lips. Each of the sealing lips has a sealing lip cutaway in at least one location. The sealing lip cutaways of two adjacent sealing lips are offset relative to each other. The cap base body in the region covered by the first sealing lip has at least one cap base body cutaway which is offset relative to the sealing lip cutaway of the first sealing lip.

The region covered by the first sealing lip relates to a view along an axis extending parallel to the cap wall. When viewed through the cap base body cutaway along such an axis in the direction of the sealing lip, the sealing lip is visible through the cap base body cutaway. In contrast, the cap base body cutaway and the sealing lip cutaway of the first sealing lip do not lie on such an axis which extends parallel to the cap wall.

After the cap has been placed over a vent body of a light housing, the outer surface faces substantially away from the light housing and the inner surface is directed towards the light housing. The cap wall extending from the inner surface is arranged substantially perpendicularly to the inner surface, at an angle of 90°±10°, for example, including exactly 90°. The cap wall also has an outer surface, from which at least one first sealing lip and one second sealing lip extend, and are arranged substantially parallel to the cap base body. The first sealing lip and the second sealing lip as well as additional sealing lips, which may be present, are not connected to each other, but are arranged at various distances from the cap base body. The first sealing lip is positioned closest to the cap base body. The second sealing lip is positioned farther from the cap base body, and any additional sealing lips are positioned successively farther away from the cap base body.

The cap base body has at least one cap base body cutaway, through which the inflow of an air stream from the outer surface of the cap base body towards the inner surface or conversely an outflow of an air stream from the inner surface of the cap base body towards the outer surface of the cap base body is enabled. When an air stream enters in the direction of the inner surface, the cap base body cutaway correspondingly represents the start of the flow path.

The at least one cap base body cutaway is located in the region covered by the first sealing lip when viewed along the axis of the cap wall. Consequently, based on the flow path described previously for exemplary purposes, after passing through the at least one cap base body cutaway a corresponding air stream encounters the first sealing lip, with the result that the first sealing lip in conjunction with the inner surface of the cap base body constitutes a limitation for the axial propagation of the air stream relative to the axis of the cap wall. According to particular further developments, one cap base body cutaway or two cap base body cutaways may be present.

It will be noted that the sealing lips do not, however, encircle the cap wall completely, as there is a cutaway in at least one location of the sealing lip. At the sealing lip cutaway, the sealing lip may be entirely interrupted or at least partly interrupted for allowing the air stream passing between the inner surface of the cap base body and the first sealing lip to pass axially relative to the axis of the cap wall through the sealing lip cutaway in the first sealing lip, so that the subsequent course of the stream passes between the first sealing lip and the second sealing lip. In similar fashion, the second sealing lip also has at least one sealing lip cutaway, so that the air stream passing between the first sealing lip and the second sealing lip in turn can flow through the sealing lip cutaway in the second sealing lip.

When viewed along the axis of the cap wall, the cap base body cutaway is offset relative to the sealing lip cutaway in the first sealing lip, which in turn is offset relative to the sealing lip cutaway in the second sealing lip. Each sealing lip cutaway of a following sealing lip being offset with respect to the sealing lip cutaway of the preceding sealing lip. If multiple sealing lip cutaways exist for each sealing lip, the respective sealing lip cutaways of adjacent sealing lips are offset with respect to each other. In this way, a labyrinthine flow path is created which forces the air stream to change direction repeatedly all along the flow path. This advantageously creates dead spaces, where dirt particles can be separated and deposited from the air stream and/or moisture in the air stream can condense more effectively than in other locations. Consequently, this configuration serves to ensure that dirt particles and/or moisture which may be contained in an air stream which enters the cap base body cutaway is/are at least partly deposited or condensed along the flow path as it winds its way inside the cap. According to a further development, the sealing lip cutaways of two adjacent sealing lips are offset by 90° relative to the axis of the cap wall. According to another further development this offset is 180°. In particular, it is provided according to one further development that in the sequence of sealing lip cutaways with three or more sealing lips angles of both 180° and 90° may occur. However, angles other than these are also used, for example angles of 45°, 60°, 120° or 270° are possible.

In an embodiment, the cap has exactly three sealing lips, that is to say a first sealing lip, a second sealing lip and a third sealing lip. This advantageously enables the production of an easily manufactured cap which still has a good cleansing effect on an air stream that passes through it.

In an embodiment, each sealing lip has exactly one sealing lip cutaway. In this way, the mechanical weakening of each sealing lip is advantageously minimized, and at the same time the effect of existing dead spaces which encourage the deposition of dirt particles or condensed moisture is maximized, given the absence of additional possible flow paths apart from the flow path provided by the one sealing lip cutaway in each sealing lip.

In an embodiment, an inner hollow cylinder forms a curtain wall extending inside the region of the inner surface of the cap base body which is bordered by the cap wall starting from the inner surface of the base body. The curtain wall is shorter according to a particular further development, and so extends a smaller distance from the cap base body than the cap wall from which the sealing lips extend. It is possible to strengthen the attachment of the cap to the vent body using static friction in cooperation with an inner guide wall of a light housing vent body, which will be discussed in greater detail subsequently.

In an embodiment, the base body cutaway is configured to enable engagement of a detent, for example a detent of a light housing vent body. Accordingly, an additional or alternative development is provided for connecting such a vent body to the cap reversibly. In such case, the detent protrudes through the at least one base body cutaway, but does not fill the base body cutaway so completely that the flow path from the outside atmosphere into the cap or out of the cap into the outside atmosphere is obstructed. According to an embodiment, the cap has two base body cutaways, each of which is configured to enable engagement of a detent, thereby enabling a stronger connection.

The cap base body may have any shape, for example in a plan view and along the axis of the cap wall it may be square, rectangular, polygonal or irregularly shaped. The cap wall and curtain may also have any shape, for example in cross section it may be circular, elliptical, square, rectangular, or it may have the form of a prism or irregular polygon. According to one particular embodiment, it is a circular cylinder. In a further development, the cap base body is circular in shape and the cylinder of the cap wall and the curtain wall are embodied as circular cylinders. In yet another development, the center points lie on the same axis such that the cap base body, the cap wall and the curtain wall are concentric.

In accordance with the present disclosure, an assembly is provided which includes a cap as described herein and a vent body. The vent body includes a vent body plate with a ventilation opening, an inner guide wall, an outer guide wall and an outer wall which extend substantially perpendicularly from the vent body plate. The inner guide wall partially encircles the ventilation opening. The outer guide wall partially encircles the inner guide wall. The outer wall completely encircles the outer guide wall, so that a flow path is created with a labyrinthine course substantially in a plane disposed parallel to the vent body plate from the ventilation opening along the inner guide wall and the outer guide wall, and in the reverse direction. In the assembly, the cap base body lies flush against the outer wall of the vent body, and the sealing lips of the cap wall of the cap lie flush against the outer wall. As a result, a further labyrinthine course in the flow path with labyrinthine course substantially in a plane disposed parallel to the vent body plate described above. This further course is however in a plane substantially perpendicular to the aforementioned plane.

As used herein, a labyrinthine course includes at least two changes of direction, particularly sharp changes of direction, of the flow paths. In the assembly described herein, a flow path is created by the inner guide wall, the outer guide wall and the outer wall in which an air stream passing through may flow substantially parallel to the plane of the vent body plate, since the vent body plate and the inner surface of the cap define lateral limits for the flow path. The inner guide wall and the outer guide wall are offset with respect to each other. An air stream must consequently make a change of direction in order to pass from the space partially enclosed by the inner guide wall into the space between the inner guide wall and the outer guide wall, and must make a further change of direction in order to pass into the space between the outer guide wall and the outer wall. The labyrinthine course and the changes of direction the air stream is forced to make already facilitate the precipitation of moisture and/or dirt particles entrained in the air stream. But the sealing lips of the cap wall of the cap, which lie flush with the outer wall create an additional labyrinthine course which the flow path must follow since an air stream moving therein is constricted laterally by the cap wall and the outer wall and must make changes of direction at the sealing lip cutaways. Without the cap sealing lips the air stream would flow substantially parallel to the plane of the vent body plate. As such, the sealing lips and the sealing lip cutaway create an additional labyrinthine course, which extends substantially perpendicularly to the aforementioned plane and forces an air stream to make additional changes of direction. These additional changes of direction advantageously offer further capabilities for precipitating moisture and/or dirt particles entrained in the air stream.

According to a further development, the additional labyrinthine course is accordingly created between the cap base body cutaway and the vent body plate. Accordingly, additional capabilities for precipitating moisture and/or dirt particles out of the air stream between these two locations are provided by the additional labyrinthine course.

According to a further development, the vent body plate, from which the inner guide wall, the outer guide wall and the outer wall extend, is routed at least largely in one plane or largely in several parallel planes, which also extend parallel to the plane of the cap base body. At some points, but not in most cases, the vent body plate may have a complex surface profile. Accordingly, where reference is made to the plane of the vent body plate, this reference is based on the plane that currently predominates and typically will be a plane which extends parallel to the plane of the cap base body.

The inner guide wall, the outer guide wall and the outer wall are arranged substantially perpendicularly to the vent body plate, for example at an angle of 90°±10°, including exactly 90°. Since it is intended to ensure that the cap and the vent body function together, which includes placing the cap over the vent body, it is provided that if the angle differs from 90° the cap wall of the cap on the one hand and the inner guide wall, the outer guide wall and the outer wall of the vent body on the other hand each feature corresponding deviations, enabling the cap to be fitted accordingly.

The vent body includes the vent body plate with the ventilation opening. When the cap is placed in position, a space delimited by the outer wall is created between the cap base body and the vent body plate, which space extends radially relative to the cap wall, and in which an air stream may pass between the at least one cap base body cutaway and the ventilation opening. However, the inner guide wall and the outer guide wall serve to render a direct flow path in substantially radial direction between the at least one cap base body cutaway and the ventilation opening impossible. Instead, a labyrinthine flow path is forced by the arrangement of the inner guide wall and the outer guide wall with respect to each other. Thus, an air stream from the outer wall to the ventilation opening cannot flow radially without obstruction, it is first guided between the outer wall and the outer guide wall until the outer guide wall ends, and is not able to enter the region between the outer guide wall and the inner guide wall until it reaches locations where the outer guide wall is interrupted.

Similarly, an air stream which is directed between the outer guide wall and the inner guide wall is not able to flow unobstructed in the direction of the ventilation opening, but must first reach locations where the ventilation opening is no longer bordered by the inner guide wall and is thus shielded thereby. The flow path which is imposed by the outer wall, the outer guide wall and the inner guide wall is routed in a plane that is aligned substantially parallel to the plane of the vent body plate. The dead spaces created in this flow path facilitate the deposition of dirt particles entrained in the air stream and effectively bring about the condensation of entrained moisture. If the sealing lips of the cap were not present, the result would merely be this flow path routed substantially parallel to the plane of the vent body plate.

However, the capability of the assembly to cause dirt particles to be deposited and to effectively cause entrained moisture to condense may advantageously be enhanced if the first and second sealing lips with associated sealing lip cutaways extend out from the cap wall of the cap. As soon as the cap is arranged on the vent body, the cap wall protrudes into the space delimited by the outer wall and the outer guide wall. An additional labyrinth is set up in this space by the first and second sealing lips. Without the division created by the first and second sealing lips, an air stream would be able to move between the outer wall and the outer guide wall relatively unobstructed. However, the labyrinth formed by the first and second sealing lips and their sealing lip cutaways imposes a more complex flow path, the net flow direction of which is perpendicular to the plane of the vent body plate.

Within this space, the flow path directed substantially parallel to the plane of the vent body plate is redirected into a flow path which is routed substantially perpendicularly to the plane of the vent body plate by the at least first and second sealing lips. This is imposed due to the fact that in order to be diverted from the plane of the cap base body cutaway to the plane of the ventilation opening an air stream cannot flow freely inside the space delimited by the outer wall and the outer guide wall, but must follow the labyrinth which is arranged at least between the cap base body and the first sealing lip, and between the first sealing lip and the second sealing lip. In order to be able to move from the space between the cap base body and the first sealing lip into the space between the first sealing lip and the second sealing lip, the air stream must follow a flow path which leads as far as the first sealing lip cutaway. Since this first sealing lip cutaway is in turn offset with respect to the second sealing lip cutaway, the air stream is again unable to follow a direct line between the first sealing lip cutaway and the second sealing lip cutaway, and instead must follow a flow path which leads to the second sealing lip cutaway. As a result, the air stream must pass through an additional labyrinth, the flow path of which is routed in a different plane than the flow path from the outer wall towards the ventilation opening when the net flow direction is considered. In consequence, the arrangement effectively creates additional dead spaces and possible depositing locations for the dirt particles entrained in the air stream and/or possible condensation locations for moisture carried in the air stream.

At the same time, the sealing lips are disposed flush against the outer wall of the vent body, creating a seal that is sufficient to prevent the air stream from passing between the sealing lips and the outer wall.

When the vent body is viewed from above, the outer guide wall and the inner guide wall may have any shape. According to a particular variant, when viewed from above the outer guide wall and the inner guide wall each have the shape of incomplete circles, from which an arc is missing. This enables a simple design of the cap, of which the cap wall with sealing lips radiating therefrom must be shaped in such a way as to ensure that the cap wall is not spatially obstructed by the outer guide wall at the locations where it exists, and the sealing lips lie flush against the outer wall. In this case, the sealing lips may be constructed as circular rings on the cap wall and have a diameter which corresponds to the outer guide wall. The incomplete circles of the inner guide wall and the outer guide wall are radially offset relative to each other. Accordingly, the missing arcs of the incomplete circles are not arranged congruently with each other. The missing arcs are preferably not even arranged to overlap, so that an air stream which moves along the inner guide wall and is able to enter the space between the inner guide wall and the outer guide wall at the missing arc does not reach the missing arc in the outer guide wall without a further change of direction. The same applies in the reverse direction for air streams which enter the space between the outer guide wall and the inner guide wall at the missing arc in the outer guide wall and then are not able to reaching the missing arc in the inner guide wall without changing direction again.

According to an embodiment, the cap has an inner cap wall, which is shaped such that it lies flush against the inner guide wall at locations where the vent body has an inner guide wall. The additional frictional forces created in this way advantageously improve the attachment of the cap when it is placed on the vent body.

According to an embodiment, at least one detent is conformed on the outer wall of the vent body for engaging in the at least one cap base body cutaway of a cap described herein. According to a further development, the number of detents is equal to the number of cap base body cutaways, for example two cap base body cutaways corresponding with two detents.

The present disclosure further provides a light housing which includes a cap and ventilation assembly as described herein, particularly a light housing for use in a motor vehicle. With a light housing of such kind it is advantageously assured that air entering the light housing from the outside through the cap base body cutaway is relieved more effectively of dirt particles and/or moisture before it enters the light housing through the ventilation opening in the vent body plate.

According to an embodiment, the vent body is conformed on the light housing or on a part of the light housing as an integral component of the light housing. In this way, it is advantageously simple to produce light housings which are prepared to receive a cap as described herein. According to an embodiment, the connection between the vent body and the light housing, or a corresponding part of a light housing may be reversible. A corresponding connection may be created in a manner known in the art, for example by screwing the vent body into a corresponding opening in the light housing furnished with a suitable thread, or by attaching the vent body to the light housing with a snap-lock fitting. The reversible connection advantageously makes it possible to detach the vent body, and thus also remove any dust particles deposited before reusing the device in the light housing. Optionally, each of the light housings described in the preceding text is equipped with at least one light source.

The present disclosure further provides a motor vehicle which includes a cap, an assembly and/or a light housing such as described herein.

BRIEF DESCRIPTION OF THE DRAWINGS

The present disclosure will hereinafter be described in conjunction with the following drawing figures, wherein like numerals denote like elements.

DETAILED DESCRIPTION

The following detailed description is merely exemplary in nature and is not intended to limit the invention or the application and uses of the invention. Furthermore, there is no intention to be bound by any theory presented in the preceding background of the invention or the following detailed description.

Figure 1:
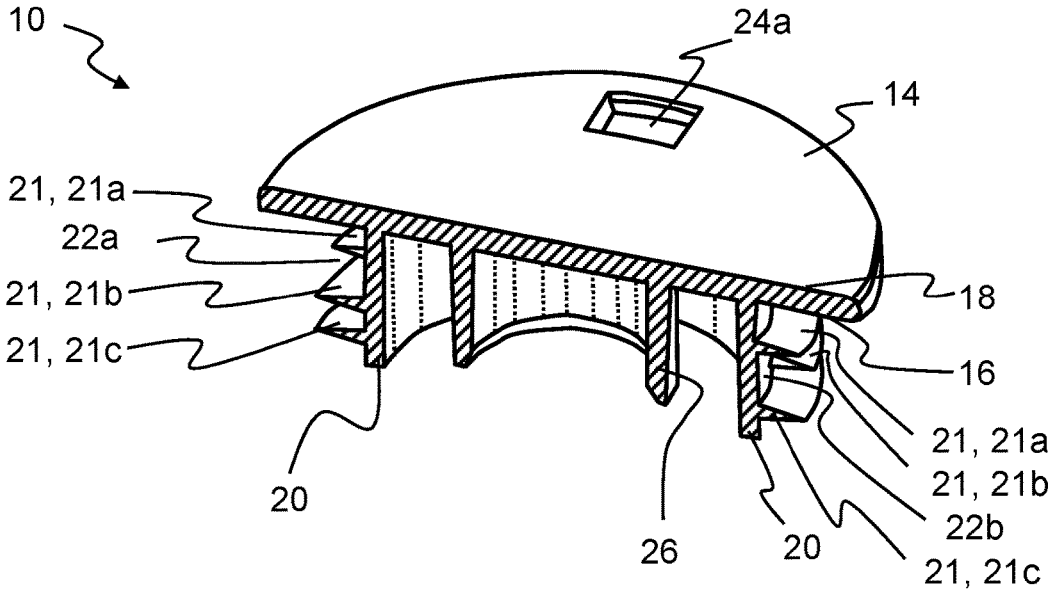
FIG. 1 shows a three-dimensional cross section of a cap.

FIG. 1 shows a three-dimensional cross section of a cap 10. Cap 10 includes a cap base body 14 having two cap base body cutaways 24*a*, 24*b* formed therein, of which—due to the sectional view—only one cap base body cutaway 24*a* is visible (cap base body cutaway 24*b* being positioned in front of the section plane). Cap base body 14 has an outer surface 18 and an inner surface 16. A cap wall 20 extends from inner surface 16. In the present case, cap wall 20 is arranged perpendicularly to inner surface 16. In the example shown here, several sealing lips 21, in particular a first sealing lip 21*a*, a second sealing lip 21*b* and a third sealing lip 21*c*, extend from the outer surface of cap wall 20, each of which is at a different distance from cap base body 14. The first sealing lip 21*a* is closest to cap base body 14, the second sealing lip 21*b* is located farther away from it, and the third sealing lip 21*c* is at the greatest distance from cap base body 14.

Because of the section plane, two sealing lip cutaways are visible, specifically sealing lip cutaway 22*a* in first sealing lip 21*a* and sealing lip cutaway 22*b* in second sealing lip 21*b*. Both sealing lip cutaways 22*a, b* are discernible because the associated first sealing lip 21*a* and second sealing lip 21*b* do not continue as far as the section plane. Cap base body cutaway 24*a* lies in the region which is covered by the first sealing lip 21*a*. Accordingly, the first sealing lip 21*a* would be visible below cap base body cutaway 24*a* in a view through cap base body cutaway 24*a* along an axis parallel to cap wall 20.

Sealing lip cutaway 22*a* is offset relative to cap base body cutaway 24*a* by 90° about the axis of cap wall 20. Sealing lip cutaway 22*b* is also offset relative to sealing lip cutaway 22*a* about the axis of cap wall 20. In the present case an angle of 180° exists about the axis of cap wall 20.

Also represented in FIG. 1 is a curtain wall 26 in the form of an inner hollow cylinder. In the example shown here, the curtain wall is shorter than cap wall 20, and thus does not extend as far beyond inner surface 16 as cap wall 20 starting from cap base body 14.

Figure 2:
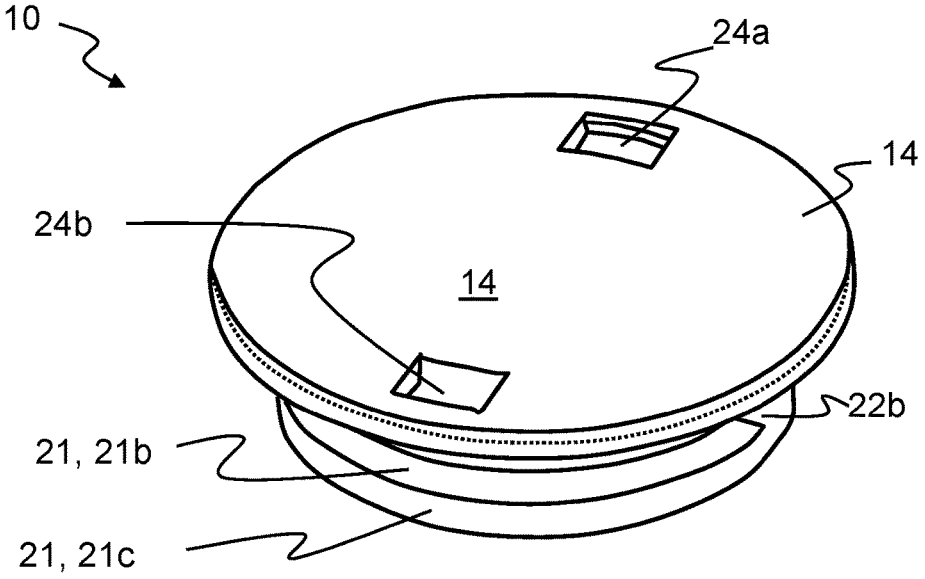
FIG. 2 shows a three-dimensional view of the cap of FIG. 1.

FIG. 2 shows the complete cap 10 of FIG. 1, so that in addition to the first cap base body cutaway 24*a* in FIG. 1, the second cap base body cutaway 24*b* is also visible in cap base body 14. A part of the component is obscured by cap base body 14, so that only the second sealing lip 21*b* with its sealing lip cutaway 22*b* and the third sealing lip 21*c* below that are visible.

Figure 3:
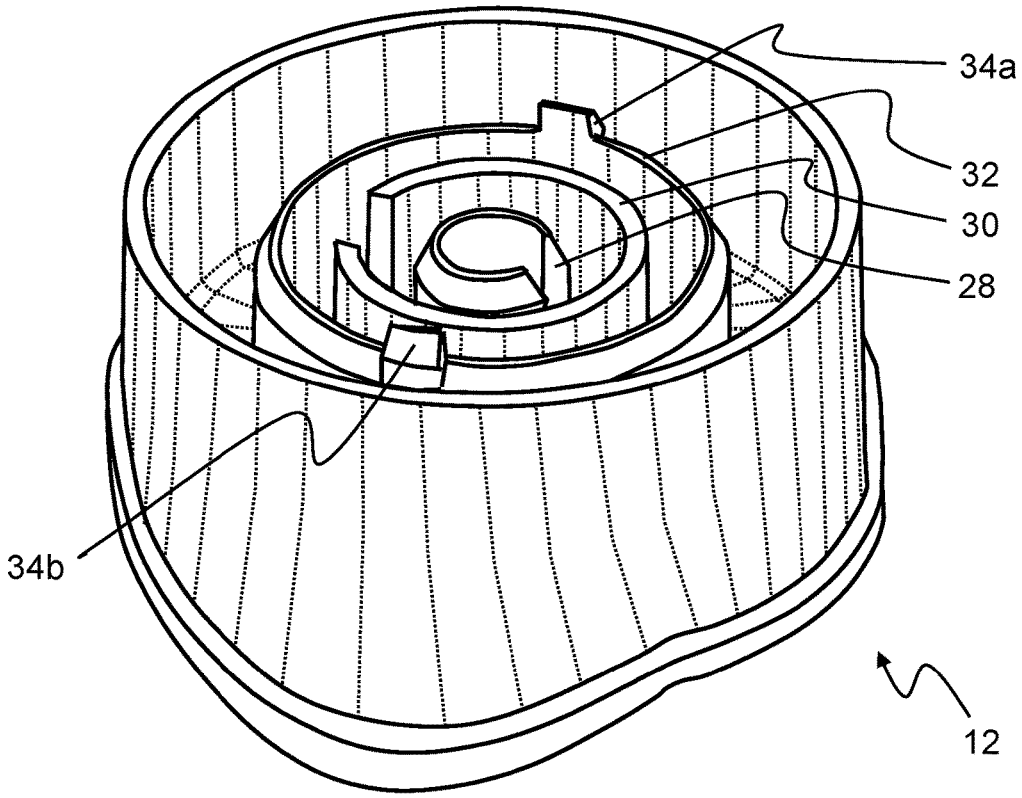
FIG. 3 shows a three-dimensional view of a vent body.

FIG. 3 shows a three-dimensional view of a vent body 12, in which contour lines have been provided as dotted lines to illustrate the surface shape. Also visible in FIG. 3 are an inner guide wall 28, an outer guide wall 30, which partially encircles inner guide wall 28, and an outer wall 32, which completely encircles outer guide wall 30. Two detents 34*a* and 34*b* are conformed on outer wall 32. Other structures which are not necessary for understanding are not identified with reference signs. In a view from above, inner guide wall 28 and outer guide wall 30 have the form of incomplete circles which are radially offset from each other so that the missing circle arcs are not congruent with each other.

Figure 4:
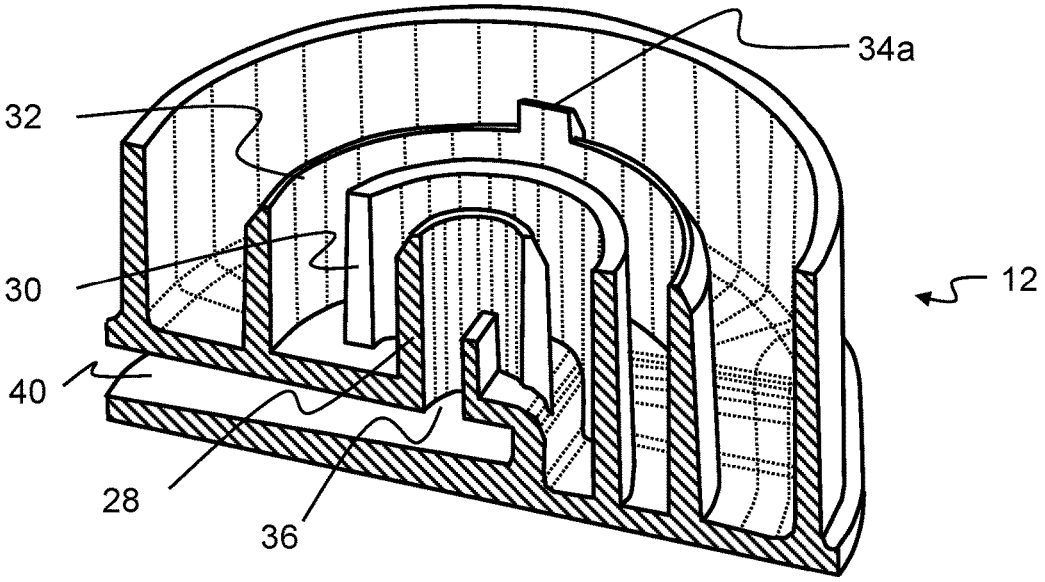
FIG. 4 shows a three-dimensional cross section of the vent body of FIG. 3.

FIG. 4 shows a cross-sectional view for comparison with FIG. 3, and reveals further details. In this representation, a ventilation opening 36 is visible and is partially encircled by inner guide wall 28, which in turn is partially encircled by outer guide wall 30. Outer wall 32 with its two detents 34*a, b*, of which only detent 34*a* is visible due to the section plane, since detent 34*b* is located in front of the section plane and therefore does not appear, encircles outer guide wall 30 completely. Ventilation opening 36 opens into a ventilation channel 40, which would lead into the interior of a light housing—not shown—when vent body 12 is mounted on such a light housing.

Figure 5:
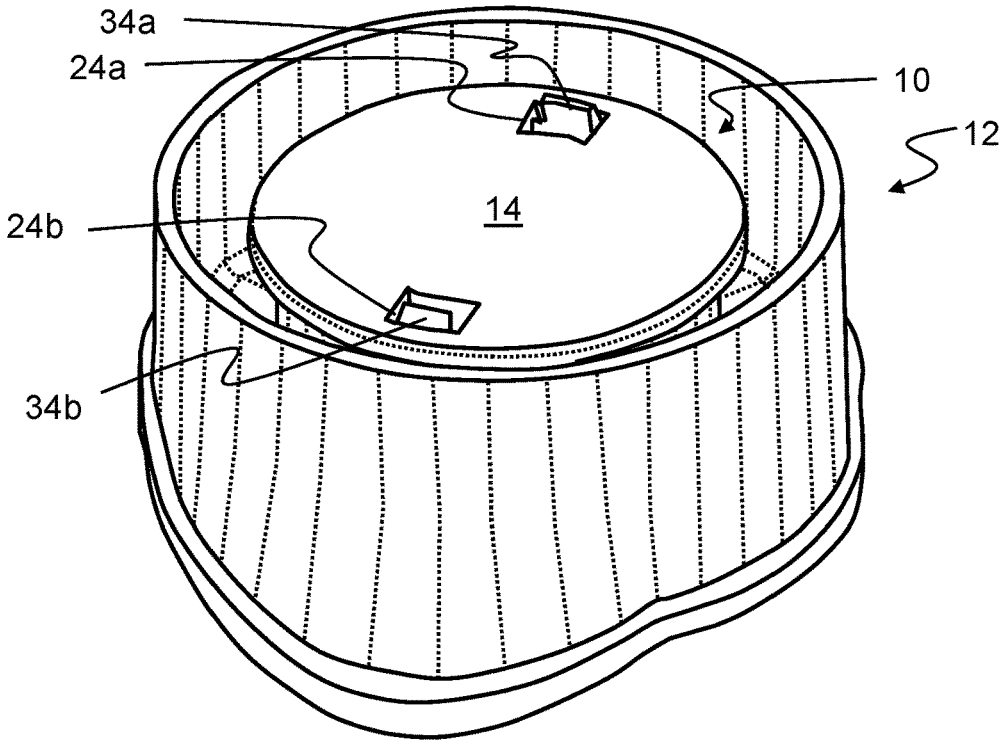
FIG. 5 shows a three-dimensional view of an assembly with cap and vent body.

FIG. 5 shows a three-dimensional view of an assembly including a cap 10 according to FIGS. 1 and 2 and vent body 12 according to FIGS. 3 and 4. In the chosen representation, apart from vent body 12, cap base body 14 with the two cap base body cutaways 24*a, b*, each of which is engaged with the two detents 34*a,b* of vent body 12, are also substantially visible from the outside.

Figure 6:
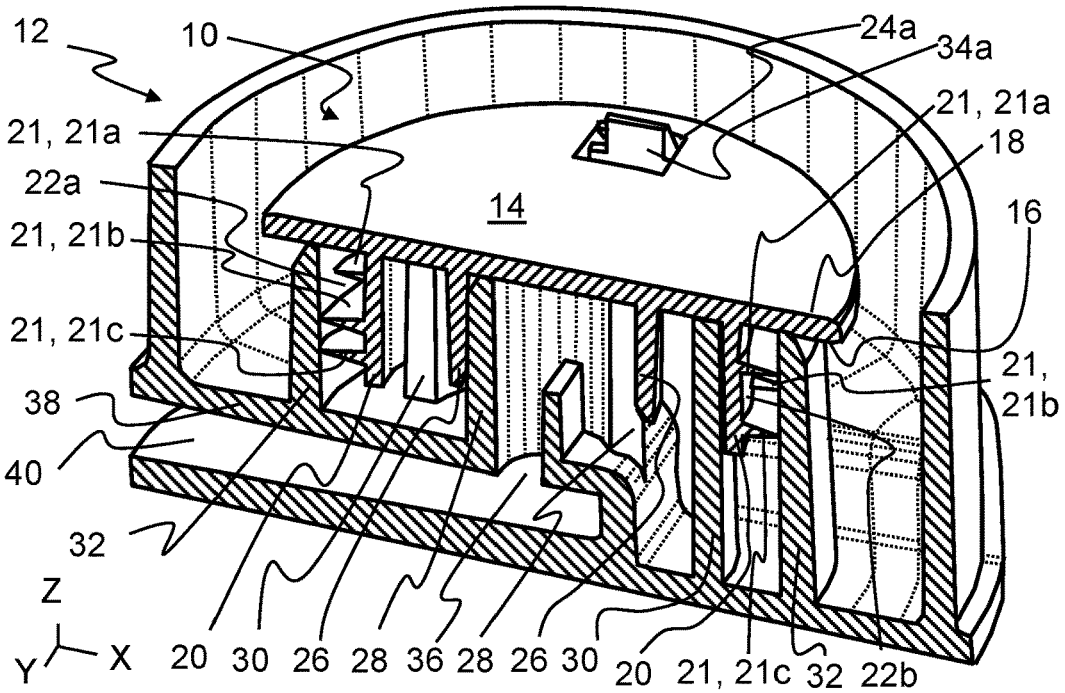
FIG. 6 shows a three-dimensional cross section of the assembly of FIG. 5.

FIG. 6 shows a cross-sectional representation corresponding to FIG. 5, in which further details are visible. Cap 10 is placed over vent body 12. The static friction between the curtain wall 26 of cap 10 and the inner guide wall 28 of vent body 12 among other factors provides a certain retaining force. The actual fastening is assured by detents 34*a, b*, which are in engagement with the associated cap base body cutaways 24*a* and 24*b*, wherein—because of the section plane—only detent 34*a* and cap base body cutaway 24*a* are visible in FIG. 6.

Cap base body cutaway 24*a* represents a possible starting point of a flow path which passes inside cap 10 and vent body 12. The flow path first passes between the inner surface 16 of cap 10 and the first sealing lip 21*a*, until the air stream being guided therein can continue in the axial direction relative to cap wall 20 into the region between the first sealing lip 21*a* and the second sealing lip 21*b* at sealing lip cutaway 22*a* of the first sealing lip 21*a*. Then, in the same way at sealing lip cutaway 22*b* of the second sealing lip 21*b*, the air stream continues through the flow path enabled thereby into the region between the second sealing lip 21*b* and the third sealing lip 21*c*, after which, having followed this flow path it enters the region between the third sealing lip 21*c* and vent body plate 38 at sealing lip cutaway 22*c* of the third sealing lip 21*c*, which is not visible in FIG. 6. In the vent body 12 shown here, sealing lip cutaway 22*c* would be arranged behind the image plane and would be offset by an angle of 90° or 270° relative to sealing lip cutaway 22*b*. The flow path, which is dictated by the first, second and third sealing lips 21*a*, 21*b* and 21*c*, is routed in a plane that in turn extends perpendicularly to vent body plate 38 and accordingly is a flow path having a course which extends generally along the Z-axis in the coordinate system which is supplied to facilitate orientation. The air stream cannot flow axially except at the locations of sealing lip cutaways 22*a,b,c*.

After passing the first, second and third sealing lips 21*a*, 21*b*, 21*c* and curtain wall 26 does not extend as far as vent body plate 38, but the air stream is prevented from advancing directly to the ventilation opening 36—shown in a central position in the present example—by inner guide wall 28, which extends from vent body plate 38. However, the air stream is able to reach ventilation opening 36 as soon as the inner guide wall 28 ends in the course of the flow path. The flow path between outer guide wall 30 and ventilation opening 36 is routed substantially in a plane parallel to vent body plate 38, which in FIG. 6 is parallel to the plane defined by the X-axis and the Y-axis.

Figure 7:
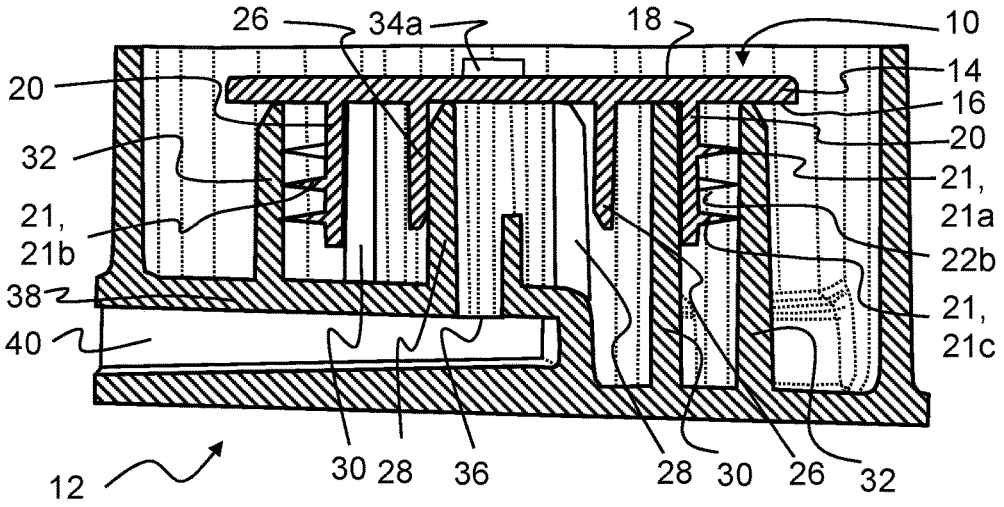
FIG. 7 shows a longitudinal section of the assembly of FIG. 5.

FIG. 7 shows a lengthwise section of the assembly of FIG. 5 with sectional surfaces being identified by hatching. To enable better comparability with FIG. 6, parts that are positioned behind the section plane are shown without hatching, and surface contours are indicated with dotted lines. Cap 10 has a cap base body 14 which has an outer surface 18 and inner surface 16 on the opposite side thereof. Cap wall 20, from whose outer surface multiple sealing lips 21, namely a first sealing lip 21*a*, a second sealing lip 21*b* and a third sealing lip 21*c* again extend substantially parallel to cap base body 14, extends perpendicularly from inner surface 16. In the cap wall 20 shown on the right side, the lengthwise section plane passes through sealing lip cutaway 22*b* of second sealing lip, 21*b* which follows behind the section plane and is not identified with a reference number to preserve clarity, in the cap wall 20 shown on the left side. The lengthwise section plane passes through sealing lip cutaway 22*a* of the first sealing lip 21*a*, which are also not identified with a reference number to preserve clarity. Detent 34*a* extends behind the section plane over the horizontal plane of outer surface 18 of cap 10 in FIG. 7.

Ventilation opening 36 is located in the lengthwise section plane in vent body plate 38 of vent body 12, and serves as the entrance to a ventilation channel 40 which extends both in front of and behind the lengthwise section plane. In the representation of FIG. 4, which provides clearer illustration, outer guide wall 30 is visible to the right of the ventilation opening 36 and behind the lengthwise section plane, and on the left of ventilation opening 36 the inner guide wall 28 is visible, the left part of which is located in the lengthwise section plane and the right part of which is behind the lengthwise section plane. Cap 10 is placed over inner guide wall 28 with frictional connection with curtain wall 26, and over outer guide wall 30 with frictional connection with cap wall 20. The first sealing lip 21*a*, the second sealing lip 21*b* and the third sealing lip 21*c* lie flush against the outer wall 32 of vent body 12 in sealing manner, with the exception of the respective sealing lip cutaways 22*a, b, c*, of which only sealing lip cutaways 22*a* and 22*b* are in the section plane and thus visible.

FIG. 8 again shows the representation of FIG. 7. The illustration has been elongated and most of the reference numbers have been omitted for purposes of clarity. A feature of FIG. 8 which has not been shown before are the cross sectional planes A, B, C, D, E, F, G, H, I and J, when viewed in the axial direction relative to cap wall 20, corresponding to the arrow in FIG. 8 and the z-axis of FIG. 6. These cross sectional planes will be referenced in the following FIGS. 9A-9J. The outline of ventilation channel 40, which has a substantially rectangular profile when viewed from above from the direction of the Z-axis, is represented by dotted lines in the left half of all the partial graphics of FIGS. 9A-J as an orientation in said partial graphics.

Figure 8:
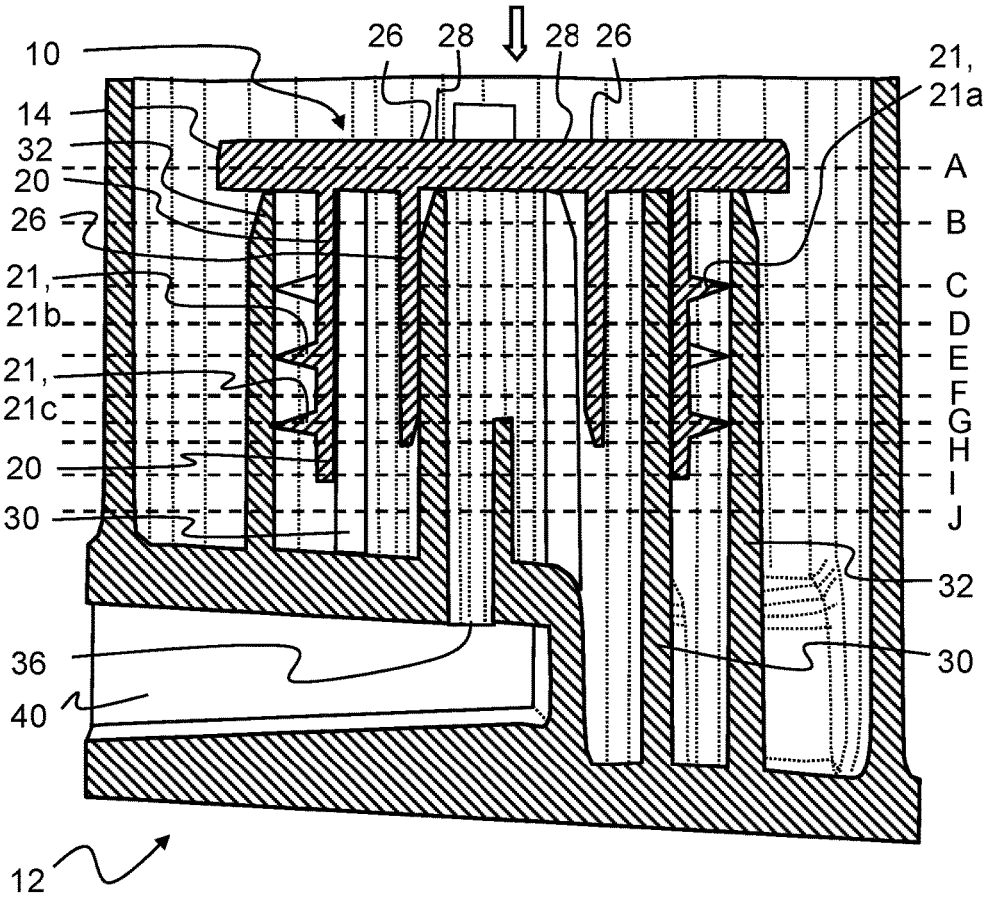
FIG. 8 shows a modified representation of the assembly of FIG. 7.
Figure 9A:
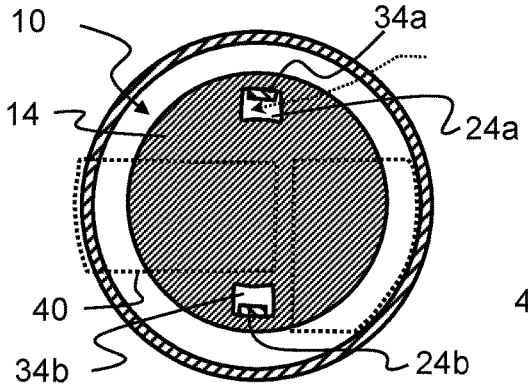
FIG. 9A-9J show cross sections of the assembly in at each of the planes A-J indicated in FIG. 8.

FIGS. 9A-J show cross sections through the assembly of FIG. 8. In FIG. 9A, corresponding to cross sectional plane A in FIG. 8, the cap base body 14 of cap 10 is substantially discernible. Cap base body 14 includes two cap base body cutaways 24*a, b*, into which the two detents 34*a,b* protrude. Cap base body cutaways 24*a, b* serve in the assembly as entry gates for a flow path from the surrounding atmosphere, for example the atmosphere surrounding a light housing or a motor vehicle, wherein inflowing air for cap base body cutaway 24*a* is illustrated for exemplary purposes with an dotted line arrow.

Figure 9B:
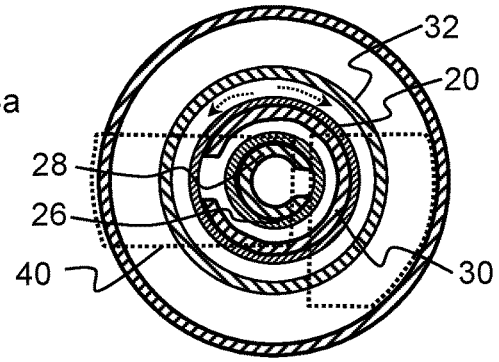

Cross sectional plane B of FIG. 8, illustrated in FIG. 9B is located between the plane of cap base body 14—no longer visible in this cross section—and the plane of the first sealing lip 21*a*, which is not yet visible in this cross section. Accordingly, outer wall 32, cap wall 20, outer guide wall 30, curtain wall 26 and inner guide wall 28 appear radially from the outside in with reference numbers. Air which has entered through base body cutaways 24*a, b* may move in this cross sectional plane between outer wall 32 and cap wall 20, as is indicated by two arrows drawn with dotted lines.

Figure 9C:
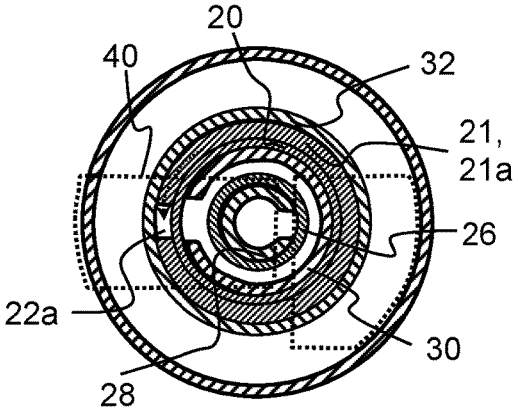

Cross sectional plane C of FIG. 8, illustrated in FIG. 9C is located on the plane of first sealing lip 21*a*. Again, outer wall 32, first sealing lip 21*a*, which originates from cap wall 20, outer guide wall 30, curtain wall 26 and inner guide wall 28 appear radially from the outside in with reference numbers. Inflowing air, which is only able to move within the plane delimited by cap base body 14 and first sealing lip 21*a*, can only move away from cap base body 14 in the axial direction, in other words leave the plane delimited by cap base body 14 and the first sealing lip 21*a*, through sealing lip cutaway 22*a* of the first sealing lip 21*a*.

Figure 9D:
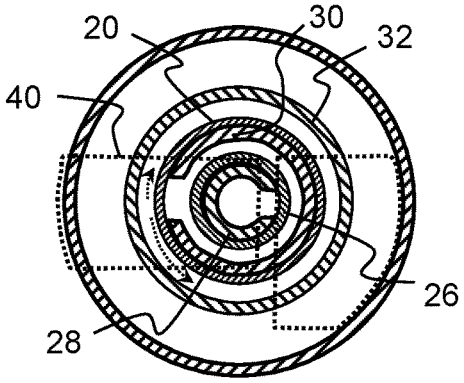

In FIG. 9D showing the cross sectional plane D of FIG. 8, the plane between the first sealing lip 21*a* and the second sealing lip 21*b* is shown. Radially from the outside in, and again identified with reference numbers, outer wall 32, cap wall 20, outer guide wall 30, curtain wall 26 and inner guide wall 28 are represented. The air flowing in through sealing lip cutaway 22*a*, which cutaway is not visible in this cross sectional plane, can only move between outer wall 32 and cap wall 20. In the axial direction towards cap base body 14, the air stream is obstructed by first sealing lip 21*a*, not visible in this cross sectional plane except for the sealing lip cutaway 22*a* thereof, and in the axial direction away from the cap base body by sealing lip 21*b*, which is also not visible in this cross sectional plane, so the air stream can move in a plane substantially delimited by these two sealing lips 21*a* and 21*b*, which is again indicated by the two dotted line arrows.

Figure 9E:
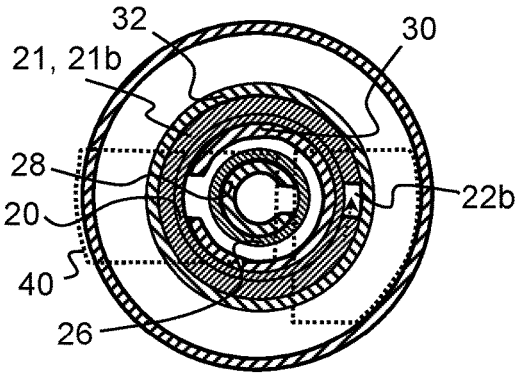

Cross sectional plane E of FIG. 8, illustrated in FIG. 9E extends inside the second sealing lip 21*b*, which is thus rendered visible. Represented radially from the outside in and identified with reference numbers, outer wall 32, second sealing lip 21*b*, which extends from cap wall 20, outer guide wall 30, curtain wall 26 and inner guide wall 28 are shown. Inflowing air, which can flow within the plane delimited by the second sealing lip 21*b* and the first sealing lip 21*a* of cross sectional plane C, can only leave this plane in the axial direction at sealing lip cutaway 22*b*. As will be evident from a comparison between cross sectional plane C and cross sectional plane E, sealing lip cutaway 22*a* and sealing lip cutaway 22*b* are offset from each other by about 180° with reference to the axis of cap wall 20.

Figure 9F:
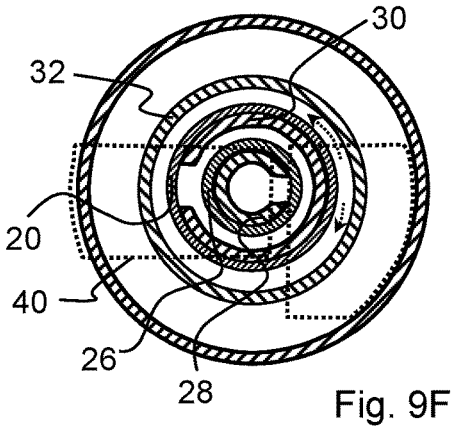

Cross sectional plane F of FIG. 8, illustrated in FIG. 9F extends in the plane between the in second sealing lip 21*b*, which is no longer visible in this partial graphic, unlike partial graphic E, and the third sealing lip 21*c*, which is not yet visible in this partial graphic. Represented radially from the outside in and again identified with reference numbers, outer wall 32, cap wall 20, outer guide wall 30, curtain wall 26 and inner guide wall 28 are shown. The air flowing in via sealing lip cutaway 22*a*—no visible in this cross sectional plane—according to partial graphic E can only move between outer wall 32 and cap wall 20. The air stream is blocked in the axial direction towards cap base body 14 by the second sealing lip 21*b*, which is not visible in this cross sectional plane with the exception of the sealing lip cutaway 22*b* thereof, and in the axial direction away from cap base body 14, by the third sealing lip 21*c*, which is also not visible in this cross sectional plane, so that the air can move in a plane which is substantially delimited by these two sealing lips 21*b* and 21*c*.

Figure 9G:
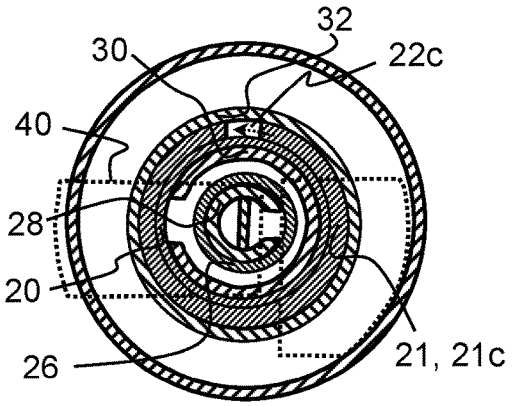

Cross sectional plane G of FIG. 8, illustrated in FIG. 9G extends inside the third sealing lip 21*c*, which is thus rendered visible. In this case, represented radially from the outside in and identified with reference numbers, outer wall 32, the third sealing lip 21*c*, which originates from cap wall 20, outer guide wall 30, curtain wall 26 and inner guide wall 28 are shown. Inflowing air which is able to flow in the plane delimited by the second sealing lip 21*b* and the third sealing lip 21*c* of the cross sectional plane G, can only leave this plane in the axial direction at sealing lip cutaway 22*c*. As is revealed by a comparison of cross sectional plane E and cross sectional plane G, sealing lip cutaway 22*b* and sealing lip cutaway 22*c* are offset from each other by about 90° relative to the axis of cap wall 20.

Figure 9H:
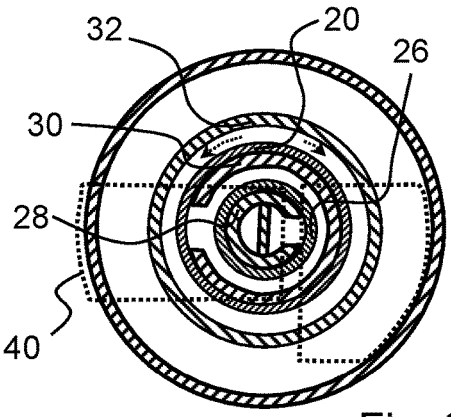

Cross sectional plane H of FIG. 8, illustrated in FIG. 9H extends below the plane of the third sealing lip 21*c*, which consequently lies outside of the section plane and is therefore no longer visible, and still within the plane of curtain wall 26, so that the visible elements represented radially from the outside in and identified with reference numbers are outer wall 32, cap wall 20, outer guide wall 30, curtain wall 26 and inner guide wall 28.

Figure 9I:
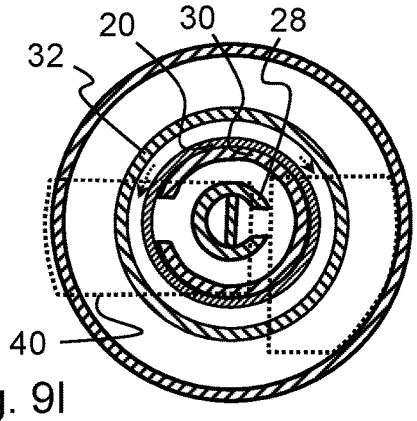

Cross sectional plane I of FIG. 8, illustrated in FIG. 9I extends below the plane of curtain wall 26, which consequently lies outside of the section plane and is therefore no longer represented, but still within the plane of cap wall 20. Accordingly, the visible elements represented radially from the outside in and identified with reference numbers are outer wall 32, cap wall 20, outer guide wall 30 and inner guide wall 28.

Figure 9J:
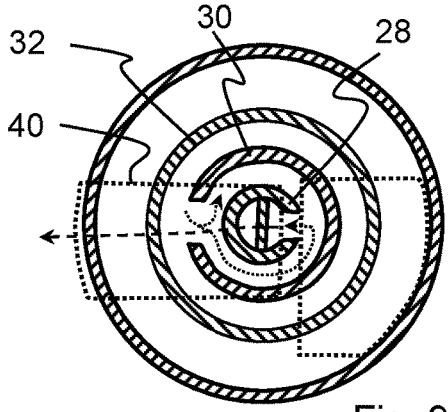
Figure 10:
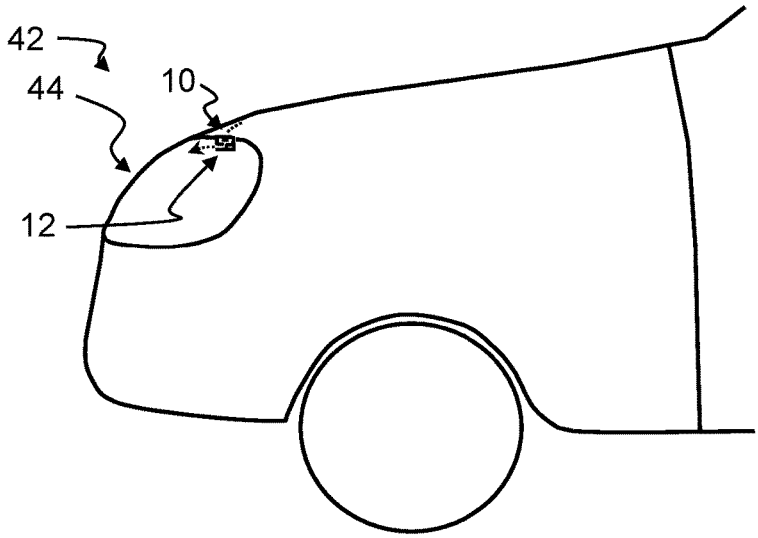
FIG. 10 is a diagrammatic cutaway view of the side of a motor vehicle.

Cross sectional plane J of FIG. 8, illustrated in FIG. 9J extends below the plane of cap wall 20 but still above the plane of vent body plate 38.

Accordingly, radially from the outside in only structures of vent body 12, namely outer wall 32, outer guide wall 30 and inner guide wall 28 are identified with reference numbers. Below the plane of cap wall 20, the air stream is able to enter between outer guide wall 30 and inner guide wall 28, and ultimately enter ventilation channel 40 within the region delimited by inner guide wall 28, as is indicated by the dashed arrow.

When FIGS. 8 and 9A-J are considered collectively, it becomes apparent that a flow path is initially provided for an air stream flowing in through a cap base body cutaway 24*a* or 24*b*, which flow path is delimited in the radial direction relative to cap wall 20 by outer wall 32 on one side and cap wall 20 on the other side, and within this restricted space flows in through the first sealing lip 21*a*, the second sealing lip 21*b* and the third sealing lip 21*c* in the manner of a labyrinth in a plane which is substantially perpendicular to vent body plate 38. After exiting this labyrinth, the flow path is routed in labyrinthine manner along outer guide wall 30 and inner guide wall 28 in a plane that extends parallel to the vent body plate 38. The additional labyrinthine flow path provided by sealing lips 21*a,b,c* results in better separation of dirt particles and/or moisture, thereby making it more difficult for them to be transported as far as the ventilation opening, or preventing such entirely.

FIG. 11 shows a schematic cutaway side view of a partially represented motor vehicle 42 having a light housing 44 in the form of a headlamp housing. Light housing 44 includes an assembly which in turn includes a cap 10 and a vent body 12. Cap 10 and vent body 12 are only represented in highly schematic fashion, thus omitting further details. The assembly allows an air stream from the atmosphere surrounding the light housing 44 to enter the interior thereof, for example, and conversely also allows an air stream to escape therefrom in the opposite direction.

While at least one exemplary embodiment has been presented in the foregoing detailed description, it should be appreciated that a vast number of variations exist. It should also be appreciated that the exemplary embodiment or exemplary embodiments are only examples, and are not intended to limit the scope, applicability, or configuration of the invention in any way. Rather, the foregoing detailed description will provide those skilled in the art with a convenient road map for implementing an exemplary embodiment as contemplated herein. It should be understood that various changes may be made in the function and arrangement of elements described in an exemplary embodiment without departing from the scope of the invention as set forth in the appended claims.

The invention claimed is:

1. A vent cap configured to cover a vent body of a light housing of a motor vehicle comprises:

a flat base body with an outer surface and an inner surface opposite the outer surface and a base body cutaway formed therein;

a cap wall extending from the inner surface along a longitudinal axis substantially perpendicular to the flat base body, the cap wall having an outer circumferential surface;

a first sealing lip extending radially from the outer circumferential surface substantially parallel to the flat base body and having a first cutaway formed therein;

a second sealing lip extending radially from the outer circumferential surface substantially parallel to the flat base body and having a second cutaway formed therein, wherein the second sealing lips is spaced from the first sealing lip along the longitudinal axis;

wherein the first and second cutaways are offset with respect to each other, and the base body cutaway is offset with respect to the first cutaway such that the base body cutaway is covered by the first sealing lip.

2. The vent cap according to claim 1, further comprising a third sealing lip extending radially from the outer circumferential surface substantially parallel to the flat base body and having a third cutaway formed therein, wherein the third sealing lips is spaced from the first and second sealing lips along the longitudinal axis.

3. The vent cap according to claim 1, wherein each of the sealing lips has exactly one cutaway formed therein.

4. The vent cap according to claim 1, further comprising a curtain wall extending inside the region of the inner surface of the cap base body encircled by the cap wall.

5. The vent cap according to claim 1, wherein the base body cutaway is configured to engage a detent of a vent body of a light housing.

6. The vent cap according to claim 1, wherein the cap base body is circular in shape and the cap wall is configured as a circular cylinder.

7. A ventilation assembly for a light housing comprising:

a vent body having:

a vent body plate with an opening formed therethrough;

an inner guide wall extending substantially perpendicularly from the vent body plate and partially encircles the ventilation opening;

an outer guide wall extending substantially perpendicularly from the vent body plate and partially encircles the inner guide wall;

an outer wall extending substantially perpendicularly from the vent body plate and completely encircles the outer guide wall; and a vent cap covering the vent body having:

a base body with an outer surface and an inner surface opposite the outer surface and a base body cutaway formed therein;

a cap wall extending from the inner surface along a longitudinal axis substantially perpendicular to the flat base body, the cap wall having an outer circumferential surface;

a first sealing lip extending radially from the outer circumferential surface substantially parallel to the flat base body and having a first cutaway formed therein;

a second sealing lip extending radially from the outer circumferential surface substantially parallel to the flat base body and having a second cutaway formed therein, wherein the second sealing lips is spaced from the first sealing lip along the longitudinal axis;

wherein the first and second cutaways are offset with respect to each other, and the base body cutaway is offset with respect to the first cutaway such that the base body cutaway is covered by the first sealing lip, wherein the base body of the vent cap lies flush against the outer wall of the vent body opposite the vent body plate such that the first and second sealing lips lie flush against the outer wall of the vent body forming a flow path with a first labyrinthine course in a radial direction and a second labyrinthine course in a vertical direction between the vent body plate and the base body.

8. The assembly according to claim 7, wherein each of the inner guide wall and the outer guide wall comprise an arcuate wall structure forming incomplete circles.

9. The assembly according to claim 7, wherein the cap wall of the vent cap is partially flush with the inner guide wall of the vent body.

10. The assembly according to claim 7, further comprising a detent formed on the outer wall of the vent body received in the cutaway of the cap base body to releasably secure the vent cap to the vent body.

11. The assembly according to claim 7, wherein the vent cap further comprised a third sealing lip extending radially from the outer circumferential surface substantially parallel to the flat base body and having a third cutaway formed therein, wherein the third sealing lips is spaced from the first and second sealing lips along the longitudinal axis.

12. The assembly according to claim 7, wherein each of the sealing lips has exactly one cutaway formed therein.

13. The assembly according to claim 7, wherein the vent cap further comprises a curtain wall extending inside the region of the inner surface of the cap base body encircled by the cap wall.

14. The assembly according to claim 7, wherein the cap base body is circular in shape and the cap wall is configured as a circular cylinder.

15. The assembly according to claim 7 further comprising a light housing, wherein the vent body extends from the light housing.

16. The assembly according to claim 15, wherein the vent body is integrally formed in the light housing.

* * * * *